US009981290B2

(12) United States Patent
Goosen et al.

(10) Patent No.: US 9,981,290 B2
(45) Date of Patent: May 29, 2018

(54) STATIC CLASSIFIER

(71) Applicant: Coal Milling Projects (PTY) Limited, Emalahleni (ZA)

(72) Inventors: Pierre Goosen, Port Elizabeth (ZA); Koot Human Steyn, Onverwacht (ZA)

(73) Assignee: Coal Milling Projects (PTY) Limited, Emalahleni (ZA)

( * ) Notice: Subject to any disclaimer, the term of this patent is extended or adjusted under 35 U.S.C. 154(b) by 85 days.

(21) Appl. No.: 14/915,595

(22) PCT Filed: Sep. 8, 2014

(86) PCT No.: PCT/IB2014/064310
§ 371 (c)(1),
(2) Date: Feb. 29, 2016

(87) PCT Pub. No.: WO2015/033312
PCT Pub. Date: Mar. 12, 2015

(65) Prior Publication Data

US 2016/0207070 A1 Jul. 21, 2016

(30) Foreign Application Priority Data

Sep. 9, 2013 (ZA) ..... 2013/06762

(51) Int. Cl.
*B07B 7/08* (2006.01)
*B07B 7/086* (2006.01)
(Continued)

(52) U.S. Cl.
CPC ..... *B07B 7/086* (2013.01); *B02C 23/12* (2013.01); *B07B 7/083* (2013.01)

(58) Field of Classification Search
CPC .. B07B 7/04; B07B 7/08; B07B 7/083; B07B 7/086; B04C 2005/136; B02C 23/10; B02C 23/12
(Continued)

(56) References Cited

U.S. PATENT DOCUMENTS 1,385,846 A * 7/1921 Sturtevant ..... B07B 4/025 209/139.2
1,709,848 A 4/1923 Hardinge
(Continued)

FOREIGN PATENT DOCUMENTS

EP 0 204 412 A2 2/2016
GB 2 132 920 A 7/1984

OTHER PUBLICATIONS

International Search Report for PCT/IB2014/064310 dated Mar. 11, 2015.

*Primary Examiner* — Joseph C Rodriguez
(74) *Attorney, Agent, or Firm* — Knobbe Martens Olson & Bear LLP

(57) ABSTRACT

Classifier (10, 100, 200) which is configured to classify air-entrained, crushed particulate material received from a pulverizer into a fine fraction which is expelled from the classifier (10) and a coarse fraction which is returned to the pulverizer for further crushing. The classifier (10) includes a plurality of adjustable inlet blades (37) which are arranged partially above an inlet (20) leading into a classification zone (19), an angle of the blades (37) being adjustable through manipulation of a blade adjustment mechanism (39) in order to optimize particle flow conditions inside the classifier (10). Furthermore, the classifier (10) includes a plurality of inclined pre-swirl vanes (47) which are disposed below the inlet blades (37), each vane (47) having a curved body. The classifier (100) includes a part conical member (102) which
(Continued)

is suspended below an operatively upper exit (31) leading from the classification zone (19).

14 Claims, 11 Drawing Sheets

(51) Int. Cl.
*B02C 23/12* (2006.01)
*B07B 7/083* (2006.01)

(58) Field of Classification Search
USPC ..... 209/718
See application file for complete search history.

(56) References Cited

U.S. PATENT DOCUMENTS 1,470,892 A * 10/1923 Sturtevant ..... B07B 4/025 209/139.2
4,693,811 A * 9/1987 Lohnherr ..... B07B 4/025 209/139.2
5,667,149 A * 9/1997 Eisinger ..... B02C 15/001 241/119
5,819,947 A 10/1998 Nardi et al.
5,957,300 A * 9/1999 Nardi ..... B02C 15/001 209/139.2
6,409,108 B1 * 6/2002 Wark ..... B02C 15/001 241/119
6,827,221 B1 * 12/2004 Brundiek ..... B02C 23/16 209/208
8,033,399 B2 * 10/2011 Pistorius ..... B07B 7/08 209/142
8,453,846 B2 * 6/2013 Baetz ..... B04C 5/12 209/139.1
8,622,328 B2 * 1/2014 Matsumoto ..... B07B 7/02 241/119
8,651,032 B2 * 2/2014 Otani ..... B02C 15/04 110/232
8,813,967 B2 * 8/2014 Plant ..... B07B 7/02 209/139.1
8,915,373 B2 * 12/2014 Lin ..... B23P 17/04 209/139.1
9,259,739 B2 * 2/2016 Aizawa ..... B02C 15/007
2002/0178698 A1 * 12/2002 Oh ..... A47L 9/1666 55/337
2012/0012687 A1 * 1/2012 Vierstra ..... B02C 23/10 241/79
2012/0138718 A1 6/2012 Daimaru et al.
2015/0314330 A1 * 11/2015 Huang ..... B07B 7/083 241/47

* cited by examiner

STATIC CLASSIFIER

CROSS REFERENCE TO RELATED APPLICATIONS

This application is a U.S. National Phase Application of PCT International Application Number PCT/IB2014/064310, filed on Sep. 8, 2014, designating the United States of America and published in the English language, which is an International Application of and claims the benefit of priority to South African Patent Application No. 2013/06762, filed on Sep. 9, 2013. The disclosures of the above-referenced applications are hereby expressly incorporated by reference in their entireties.

FIELD OF INVENTION

This invention relates to a pulveriser or mill used to crush or grind raw material such as coal, for example, into fine particles suitable for combustion in steam-generating furnaces of fossil fuel power plants. More particularly, this invention relates to a classifier used in conjunction with such a pulveriser for classifying crushed particulate material received from the pulveriser into a sufficiently fine fraction which is suitable for combustion and a coarse fraction which is rejected and returned to the pulveriser.

BACKGROUND OF INVENTION

Pulverisers are commonly used for crushing large coal or other raw material into small particles. An airstream entering the pulveriser sweeps the particles into a classifier which separates coarse particles from the airstream for regrinding and allows the finer particles to exit the classifier and to be used in a process or burned in a furnace (in the case of coal). Prior art classifiers in some cases are not as effective in returning the coarse particles or are less efficient owing to increased flow resistance caused by turbulence in certain areas within the classifier. Increased turbulence is undesirable as the classifier parts are subjected to increased wear. These inefficiencies limit the capacity of the pulveriser and negatively affect the output of boilers fed by the pulveriser (in the case of coal). Latest boiler requirements for $NO_x$ reduction require a finer product than previous type classifiers were designed for. The Inventors desire an improved static classifier which can provide the fineness required in these boilers for low $NO_x$ design burners whilst maintaining throughput of these mills.

The Inventors desire a classifier which addresses the above drawbacks.

SUMMARY OF INVENTION

In accordance with a first aspect of the invention, there is provided a classifier for use with a pulveriser which is configured to crush raw material, the classifier being configured to classify air-entrained, crushed particulate material received from the pulveriser into a fine fraction which is expelled from the classifier and a coarse fraction which is returned to the pulveriser for further crushing, the classifier including:

- a housing defining:
  - an inward classification zone;
  - an upwardly open inlet through which the entrained crushed particulate material received from the pulveriser enters the classification zone;

- an operatively upper exit and an operatively lower outlet which lead from the classification zone; and
- a plurality of adjustable classifier inlet blades which are arranged at or near the inlet, each adjustable blade including a body which comprises an operatively upstream portion which is outwardly disposed away from the inlet and an operatively downstream portion which is disposed at least partially within and/or immediately above the inlet, wherein at least part of the upstream portion of each adjustable blade is inclined with respect to the downstream portion of the blade body, the adjustable blades collectively being configured to induce swirl and to direct the entrained particulate material through the inlet into the classification zone.

The size of the area around the blades will be such as to supply a desired air/particle velocity. The Inventors believe the velocity will typically be between 4.5 and 5.5 m/s. However, this may vary depending on operating conditions. In general a velocity of about 4.5 m/s may be used where a high throughput classifier is desired and a velocity of about 5.5 m/s may be used where a high fineness product is required. The length of the adjustable blades may affect the velocity at the outlet of the blades and is therefore adjusted to meet operational requirements.

The classifier may be a static classifier and a corner of the upstream portion of each blade may be inclined at an angle of between 20° and 40° with respect to the downstream portion of the blade body when viewed edge-on from a bottom of the blade body.

The corner of the upstream portion may be separated from a remainder of the blade body by a fold line or bend line which is substantially perpendicular to a diagonal extending between a pair of opposing corners of the blade body. Each adjustable blade may include a mounting formation whereby the blade is mounted to the housing. Accordingly, the blade may be bent corner-to-corner. A remainder of the upstream portion and the downstream portion may be planar. A selection of the inclination of the angle of between 20° and 40° may depend on an expected turbulence behind the adjustable blades.

The classifier may include an inlet blade adjustment mechanism which is connected to the mounting formations of each of the blades in a configuration in which an angle of each blade body relative to the housing is adjustable in order to regulate air flow through the inlet, by adjusting the blade adjustment mechanism. In use, an air/particle velocity through the blades may be between 4.5 and 5.5 m/s.

The classifier may further include a plurality of angularly spaced apart, inclined pre-swirl vanes which are disposed upstream of the inlet blades, wherein each pre-swirl vane comprises a multi-planar body.

In accordance with a further aspect of the invention, there is provided a classifier for use with a pulveriser which is configured to crush raw material, the classifier being configured to classify air-entrained, crushed particulate material received from the pulveriser into a fine fraction which is expelled from the classifier and a coarse fraction which is returned to the pulveriser for further crushing, the classifier including:

- a housing defining:
  - an inward classification zone;
  - an inlet through which the entrained crushed particulate material received from the pulveriser enters the classification zone; and
  - an operatively upper exit and an operatively lower outlet which lead from the classification zone;

a plurality of classifier inlet blades which are arranged at or near the inlet; and a plurality of angularly spaced apart, inclined pre-swirl vanes which are disposed upstream of the inlet blades, wherein each pre-swirl vane comprises a multi-planar body.

The pre-swirl vanes may be disposed around an upper region of an outer periphery of walls of the housing defining the classification zone. The body of each vane may include an operatively upstream portion and an operatively downstream portion, the upstream and downstream portions being joined by a middle, wherein the upstream portion is downwardly inclined with respect to the middle such that the upstream portion is substantially parallel to an incoming air stream in order to minimise air flow resistance and wear; and at least part of the downstream portion is upwardly and inwardly inclined with respect to the middle and configured to direct fluid flow inward and to induce a centrifugal swirl. The upstream portion of each vane may be downwardly inclined at an angle of between 20° and 40° relative to the middle of the vane body and a fold line or bend line representing a start of the upstream portion may be parallel with a lower edge of the upstream portion. The size of an area around the pre-swirl vanes may be designed to match the air/particle velocity selected for the adjustable blades.

An outer corner of the downstream portion of each vane may be inclined at an angle between 20° and 40° with respect to the middle of the vane body. The selection of a bend angle of between 20° and 40° may be determined by analysing turbulence on a surface of the pre-swirl vanes. The middle of each vane body may be inclined at between 30° and 60° with respect to the vertical. Preferably each vane is inclined at 45° with respect to the vertical but this may depend on flow conditions within the classifier. The angle of the vanes with respect to the vertical may be calculated and modelled using fluid dynamics. Inner and outer edges of each vane may match profiles of neighbouring walls of the classifier and a gap may be defined between the outer edges of the vanes and a mill body, the gap being smaller than or equal to half a width of a pre-swirl vane. There may be at least one blade for every two pre-swirl vanes. The pre-swirl vanes may have vane-to-vane overlap of one third of at least a vane breadth.

A lower edge of the housing defining the upper exit may have an aerofoil or teardrop cross-sectional profile which is configured to reduce turbulence and flow resistance at the exit of the classifier.

The invention also extends to a classifier for use with a pulveriser which is configured to crush raw material, the classifier being configured to classify air-entrained, crushed particulate material received from the pulveriser into a fine fraction which is expelled from the classifier and a coarse fraction which is returned to the pulveriser for further crushing, the classifier including:

a housing defining:

an inward classification zone;

an inlet through which the entrained crushed particulate material received from the pulveriser enters the classification zone; and an operatively upper exit and an operatively lower outlet which lead from the classification zone, wherein a lower edge of the housing defining the upper exit has an aerofoil or teardrop cross-sectional profile which is configured to reduce turbulence and flow resistance at the exit of the classifier.

The classifier may include an open ended depending member which is at least partially disposed within the classification zone, the member having a narrow upper end and a lower end, the member diverging from the upper end toward the lower end, the upper end defining a mouth having a reduced cross-sectional area when compared with a cross-sectional area of the upper exit, wherein the upper end of the depending member is arranged within or below the upper exit.

In accordance with yet another aspect of the invention, there is provided a classifier for use with a pulveriser which is configured to crush raw material, the classifier being configured to classify air-entrained, crushed particulate material received from the pulveriser into a fine fraction which is expelled from the classifier and a coarse fraction which is returned to the pulveriser for further crushing, the classifier including:

a housing defining:

an inward classification zone;

an inlet through which the entrained crushed particulate material received from the pulveriser enters the classification zone; and an operatively upper exit defining an exit area for expelling the fine fraction and an operatively lower outlet which lead from the classification zone, and an open ended depending member which is at least partially disposed within the classification zone, the member having a narrow upper end and a lower end, the member diverging from the upper end toward the lower end, the upper end defining a mouth having a reduced cross-sectional area when compared with that of the exit area, wherein the upper end of the depending member is arranged within or below the exit area.

The depending member may be supported by a plurality of adjustable struts which permits a position of the depending member within the classification zone to be adjusted. The depending member may be in the form of a cone and the mouth of the depending member may be concentric with the upper exit such that the upper end is positioned in the middle of the upper exit. A length of the depending member, and hence the extent to which the depending member extends downwardly into the classification zone, may be adjustable.

The invention also extends to a method of modifying a classifier for use with a pulveriser, the classifier being configured to classify air-entrained, crushed particulate material received from the pulveriser into a fine fraction which is expelled from the classifier and a coarse fraction which is returned to the pulveriser for further crushing, the classifier including:

a housing defining:

an inward classification zone;

an inlet through which the entrained crushed particulate material received from the pulveriser enters the classification zone; and an operatively upper exit and an operatively lower outlet which lead from the classification zone, the method including:

retrofitting a plurality of classifier inlet blades to an upper region of the classifier at or near the inlet, each blade including a body which comprises an operatively upstream portion which is outwardly disposed away from the inlet and an operatively downstream portion which is disposed at least partially within and/or above the inlet, at least part of the upstream portion of each blade being upwardly and inwardly inclined with respect to the blade body such that the blades are configured collectively to induce swirl and to direct the entrained particulate material into the classification zone.

An angular position of the inlet blades with respect to the housing may be adjustable.

The method may include retrofitting a plurality of pre-swirl vanes to the upper region of the classifier such that the vanes are arranged below the classifier inlet blades, each pre-swirl vane comprising a multi-planar body which includes an operatively upstream portion and an operatively downstream portion, the upstream and downstream portions being joined by a middle, the upstream portion being downwardly inclined with respect to the middle such that the upstream portion is substantially parallel to an incoming air stream in order to minimise air flow resistance and at least part of the downstream portion of each vane is upwardly and inwardly inclined with respect to the middle of the vane body to direct fluid flow inward and to induce a centrifugal swirl.

The method may further include retrofitting an appendage to an operatively lower edge of a member defining the upper exit of the classifier, the appendage having an aerofoil or teardrop cross-sectional profile.

BRIEF DESCRIPTION OF DRAWINGS

The invention will now be further described, by way of example, with reference to the accompanying drawings.

In the drawings.

DETAILED DESCRIPTION OF AN EXAMPLE EMBODIMENT

Figure 1:
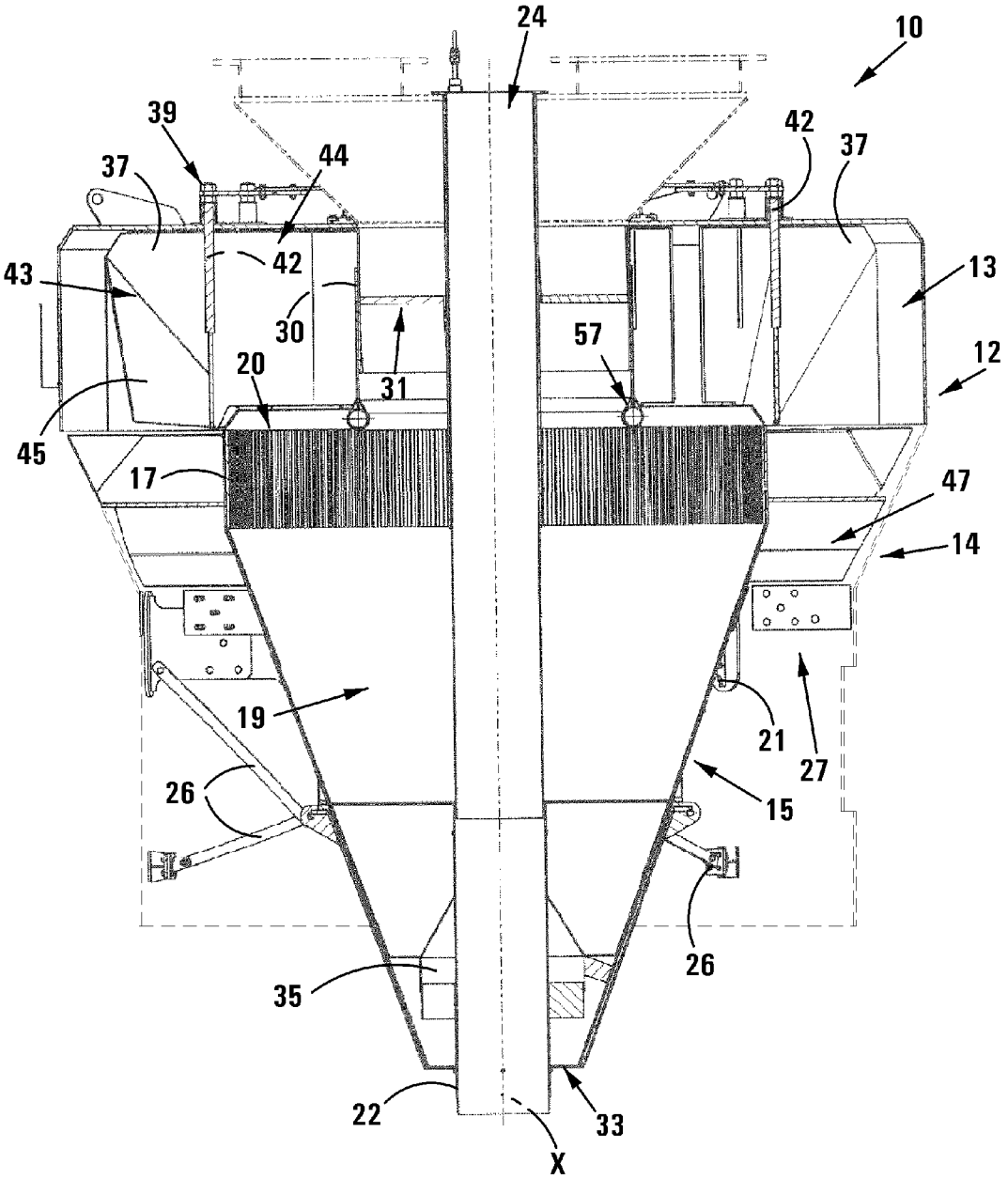
FIG. 1 illustrates a longitudinal cross-section through a classifier in accordance with the invention.

In the figures, reference numeral 10 refers generally to a classifier in accordance with the invention. The classifier 10 is configured to classify air-entrained, crushed particulate material received from a pulveriser below (not shown) into a fine fraction which is expelled from the classifier 10 and a coarse fraction which is returned to the pulveriser for further crushing. The classifier 10 includes an outer body 12 which comprises an upper part 13 and a partially cone-shaped lower part 14. The classifier 10 further includes an inner housing 15 which is concentrically arranged within the outer body 12, the inner housing 15 defining an inward classification zone 19. The inner housing 15 comprises an operatively upper cylindrical wall 17, an upper periphery of which defines an inlet 20 which leads into the classification zone 19 and an operatively lower cone or grit funnel 21. The classifier 10 further includes a cylindrical feed pipe 22 which extends lengthwise through the middle of the classifier 10 and defines a feed inlet 24 toward an operatively upper end of the pipe 22. Raw material, for example coal, received into the feed pipe 22 via the feed inlet 24 is passed through the classifier 10 along an inlet axis X to the pulveriser (not shown) positioned below the classifier 10.

The inner housing 15 is radially inwardly spaced from the outer body 12 and held fast by braces 26 which extend between the inner housing 15 and the outer body 12. An airflow pathway 27 is defined between the inner housing 15 and the outer body 12 through which air-entrained crushed particulate material from the pulveriser is conveyed into the classification zone 19 via the inlet 20. The classifier 10 further includes a cylindrical vortex finder or exit pipe 30 which is concentrically arranged about the feed pipe 22 and extends axially upward from the classification zone 19. The feed pipe 22 and exit pipe 30 together define an annular exit passageway 31 whereby fine particulate material is transported to a desired location, e.g. in the case of coal to a furnace (not shown) for combustion.

Toward a lower end of the grit funnel 21 the classifier 10 has an annular rejection outlet 33 defined between an inner wall of the funnel 21 and a downwardly depending skirt 35 which is secured around a lower periphery of the feed pipe 22. Coarse material, unsuitable for combustion, which has been separated owing to the classification action of the classifier 10, is returned to the pulveriser via the rejection outlet 33 for regrinding.

The classifier 10 further includes a plurality of angularly spaced apart classifier inlet blades 37 which are arranged at least partially above the inlet 20 leading into the classification zone 19, within an annular space defined by an inner surface of the upper part 13 of the outer body 12, an outer surface of the exit pipe 30 and the upper periphery of the cylindrical wall 17. The classifier 10 further includes a blade adjustment mechanism 39 in the form of a mechanical linkage which comprises a plurality of downwardly depending arms 42 (see FIG. 1 and FIG. 8), upper ends of which are connected to an annular linkage by a short lever. Each arm 42 extends downwardly through the upper part 13 and engages a transversely extending blind slot 40 formed in each of the blades 37 (see FIG. 2). In this configuration, axial rotation of the arm 42 results in angular displacement of the blade 37. Accordingly, by adjusting the annular linkage, the angular position of each blade 37 can be adjusted in a synchronised manner. The blades 37 can be set between angles of about 30 to 60 degrees to a radial line passing through the centre of the classifier 10.

Figure 3:
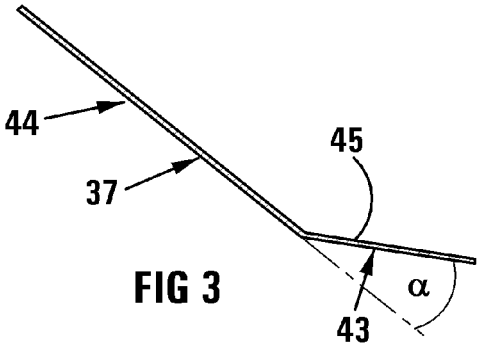
FIG. 3 shows a sectional top view of the blade of FIG. 2.
Figure 2:
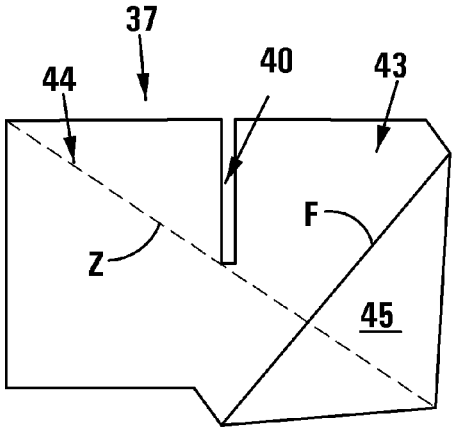
FIG. 2 illustrates a face-on view of a classifier inlet blade which forms part of the classifier of FIG. 1.
Figure 4:
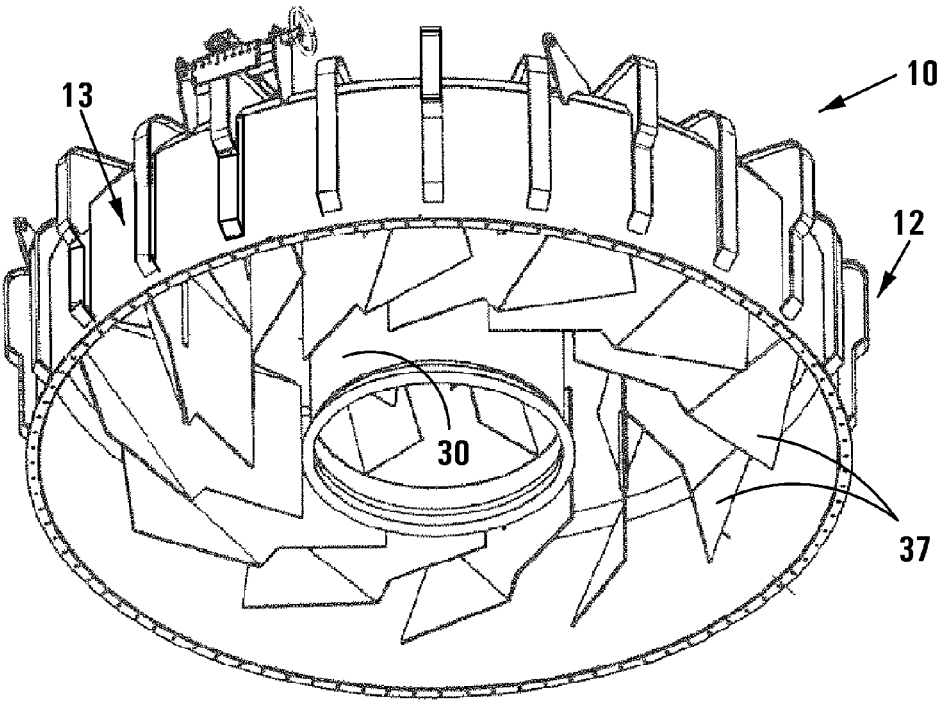
FIG. 4 shows a three-dimensional view from below of an upper part of the classifier of FIG. 1.

Each inlet blade 37 comprises a generally planar body which is divided into an operatively upstream portion 43 which is outwardly disposed away from the inlet 20 (see FIGS. 1 and 2) and an operatively downstream portion 44 which is inwardly disposed immediately above the inlet 20. In addition, a lower corner 45 of the upstream portion 43 of each blade 37 is upwardly and inwardly inclined with respect to a remainder of the blade body. The lower corner 45 is inclined at an angle $\alpha$ (FIG. 3) of between 20° and 40° with respect to the remainder of the blade body when viewed edge-on from a top. In the example embodiment illustrated the angle α is 30°. The inclined lower corner 45 defines a fold line or bend line F which is substantially perpendicular to a diagonal line Z drawn between a pair of opposing corners of the blade 37 (FIG. 2). Accordingly, the blade 37 is bent corner-to-corner. The remainder of the blade body is planar. The blades 37 are angularly spaced apart in a circular configuration such that the blades 37 collectively induce swirl or a centrifugal vortex and direct the entrained particulate material into the classification zone 19. An operatively lower edge of each blade 37 is shaped to match the profile of the upper periphery of the cylindrical wall 17 and accordingly has a slanted step formed in the downstream portion 44 immediately after the fold line F.

Figure 5:
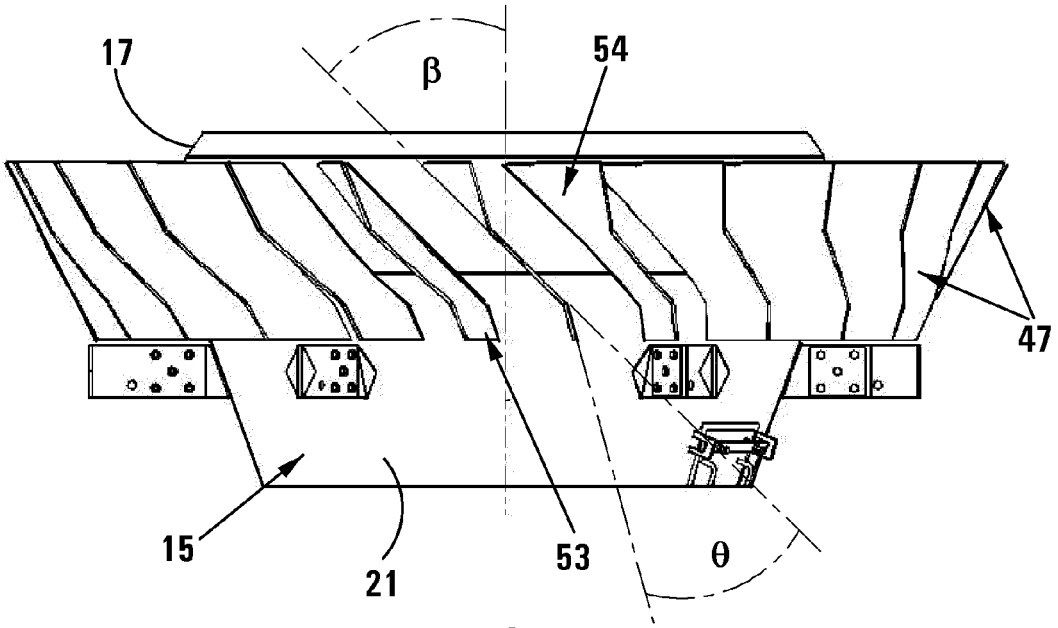
FIG. 5 illustrates a side view of part of an inner housing of the classifier including a plurality of pre-swirl vanes.
Figure 6:
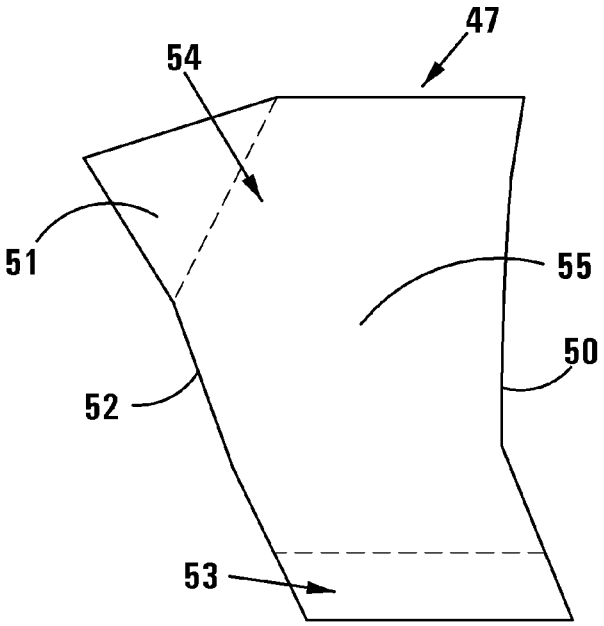
FIG. 6 illustrates a face-on view of one of the pre-swirl vanes shown in FIG. 5.
Figure 7:
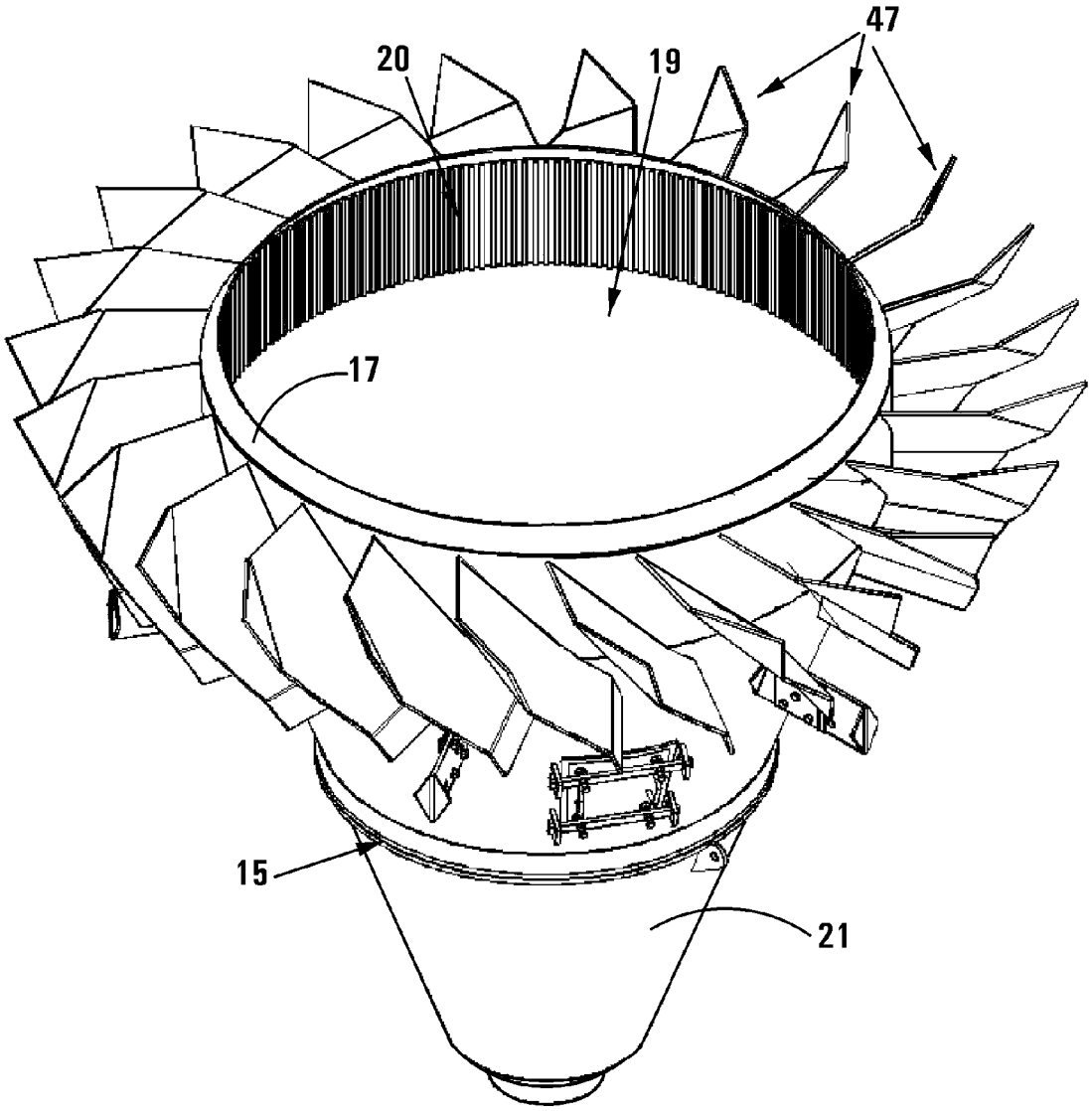
FIG. 7 illustrates a three-dimensional view from above of the inner housing.
Figure 11:
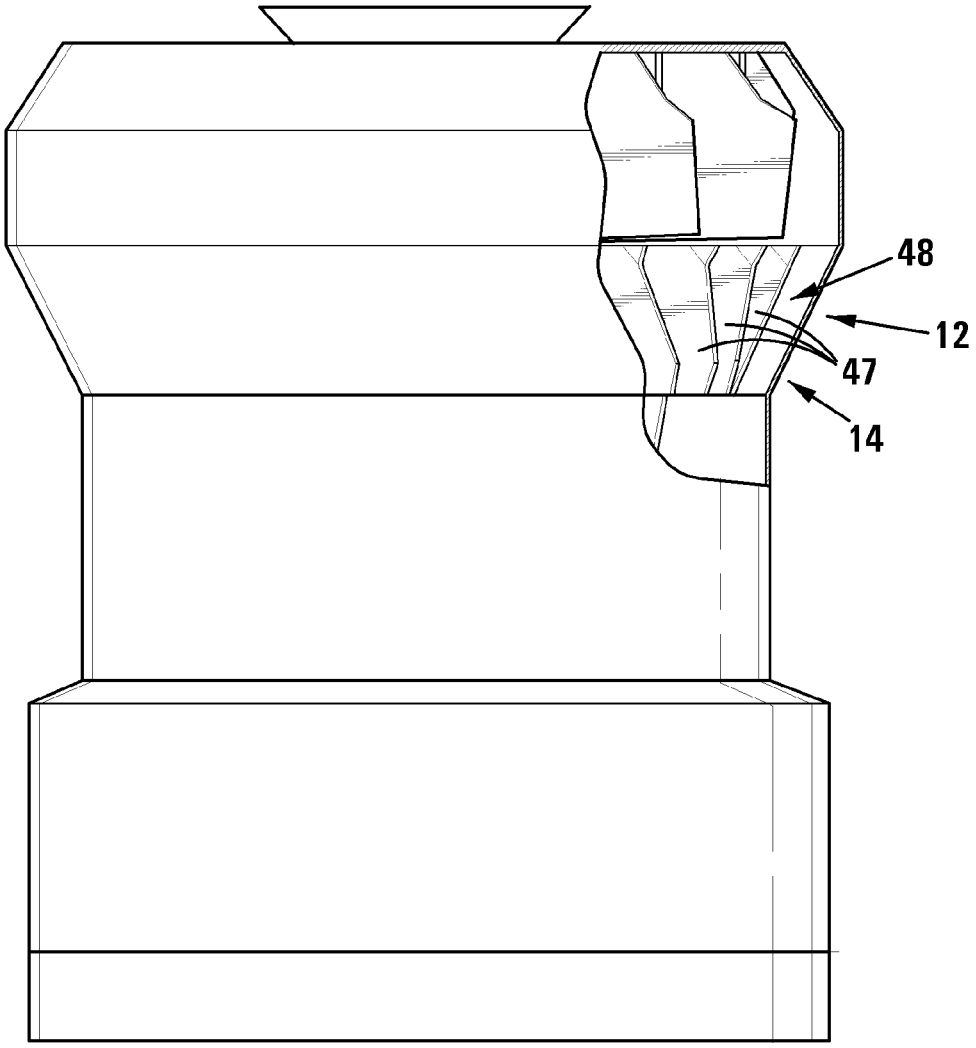
FIG. 11 illustrates a partial sectional view of part of an upper region of an example embodiment of a classifier in accordance with the invention.

In addition to the classifier inlet blades 37, the classifier 10 further includes a plurality of pre-swirl vanes 47 (FIGS. 5 to 7) which are disposed below the inlet blades 37 in the airflow pathway 27 defined between the inner housing 15 and the lower part 14 of the outer body 12. The pre-swirl vanes 47 are therefore arranged operatively upstream of the inlet blades 37. The vanes 47 are arranged about an outer periphery of the inner housing 15 at angularly spaced apart positions and project outwardly from the inner housing 15 to an inner surface of the outer body 12. A conical gap 48 (see FIG. 11) is formed between a radially outer edge of the vanes 47 and an inner surface of the lower part 14 of the outer body 12. The radial width of the gap 48 can be varied in order to meet design requirements. The Applicant has noted that an increase in the radial width of the gap 48 up to half of a radial width of the pre-swirl vanes 47 increases the efficiency of the classifier. Each vane 47 extends downwardly from the upper periphery of the cylindrical wall 17, at an inclined angle β relative to the vertical (FIG. 5), over an intersection of the cylindrical wall 17 with the grit funnel or cone 21. Referring to FIG. 6, an operatively inner edge 50 of each vane 47 has a profile which matches that of the outer surface of the inner housing 15 and similarly an outer edge 52 is profiled to match the curvature of the inner surface of the outer body 12. It is to be appreciated that the vanes 47 may be secured to either one of the inner housing 15 or outer body 12 or both. In the example embodiment illustrated the angle β is 45°.

Still referring to FIG. 6, each vane 47 has a multi-planar body which comprises an operatively upstream portion 53 and an operatively downstream portion 54, the upstream portion 53 and downstream portion 54 being joined by a planar middle 55. The upstream portion 53 is downwardly inclined with respect to the middle 55 such that the upstream portion 53 is substantially parallel to an incoming air stream in order to minimise air flow resistance. In this example embodiment, the upstream portion 53 is downwardly inclined at an angle θ of 30° relative to the middle 55 (see FIG. 5). The angle θ is dependent upon inlet flow conditions and may vary depending on the application. Furthermore, an outer corner 51 of the downstream portion 54 is upwardly and inwardly inclined with respect to the middle 55 at an angle of 30° relative to a plane of the middle 55. Note that the angle of the outer corner 51 is designed to suit flow conditions at the upstream portion 43 of the blades 37 positioned above the vanes 47. The outer corner 51 serves to direct fluid flow inward and to induce a centrifugal vortex or swirl. A fold line or bend line representing an intersection of the middle 55 and the upstream portion 53 is parallel with a lower edge of the upstream portion 53.

Figure 8:
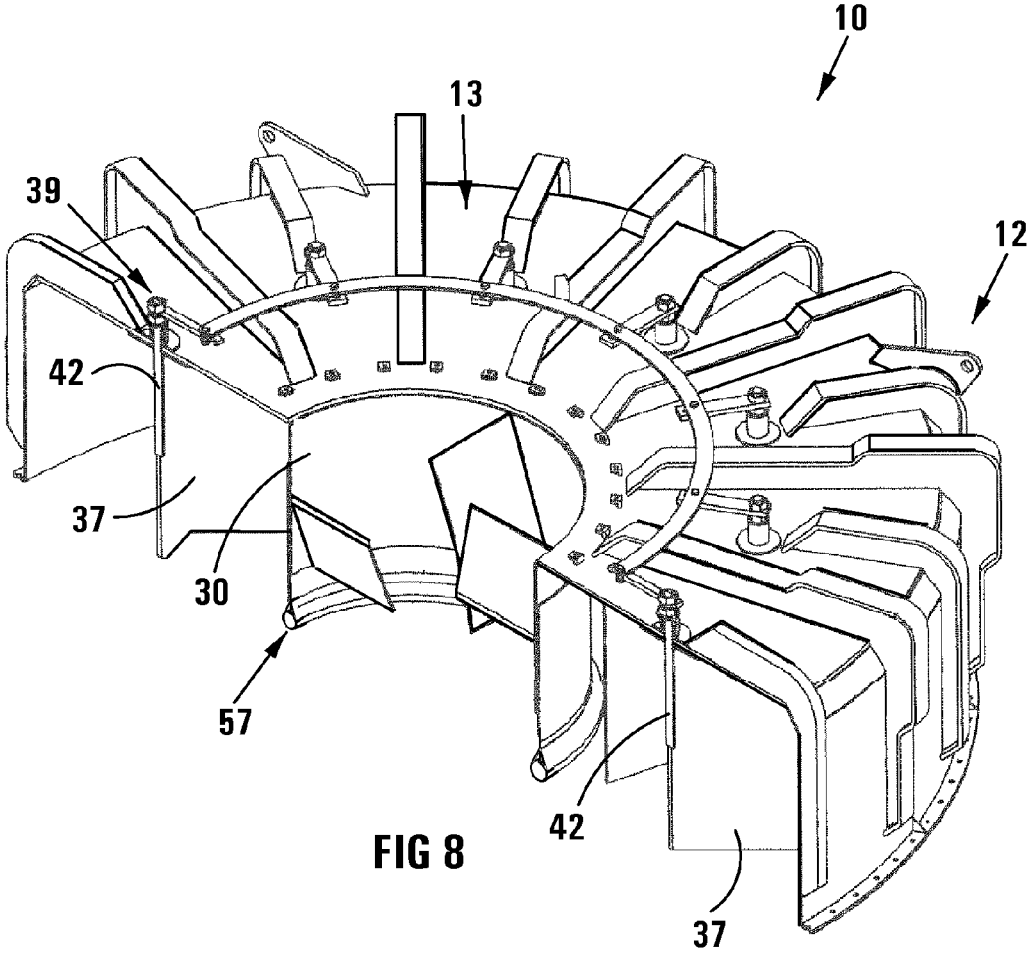
FIG. 8 shows a three-dimensional fragmentary view through the upper part of the classifier shown in FIG. 4.
Figure 9:
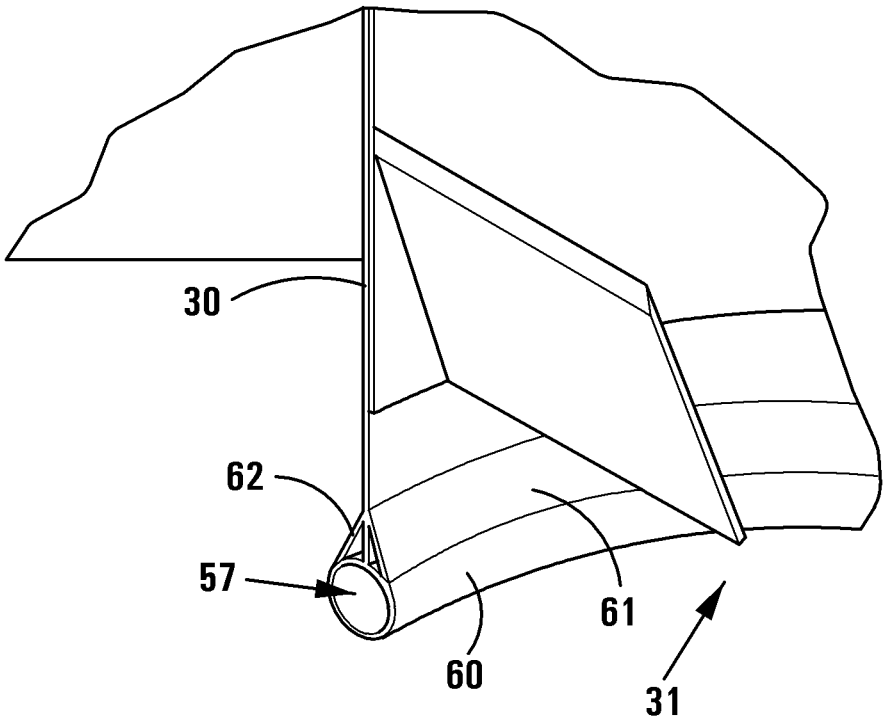
FIG. 9 shows, on an enlarged scale, part of a first embodiment of a lower edge of an exit pipe of the classifier.
Figure 10:
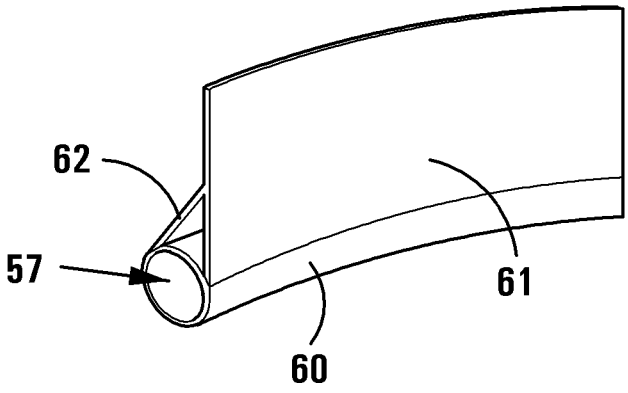
FIG. 10 illustrates a second embodiment of the lower edge of the exit pipe.

Referring now to FIGS. 8 and 9, an operatively lower edge of the vortex finder or exit pipe 30 which, together with the feed pipe 22 defines the annular exit passageway 31 has a downwardly facing, teardrop or aerofoil cross-sectional profile 57. The aerofoil profile 57 reduces turbulence and flow resistance at the exit. The lower edge is formed by attaching a ring-shaped member 60 having a round cross-sectional profile to the exit pipe 30. The teardrop profile 57 is completed by securing an inner skirt 61 and an outer skirt 62 to respective sides of the ring-shaped member 60 and the exit pipe 30, at an angle thereto. Each skirt 61, 62 is in the form of a curved strip of metal which is secured to a side of the ring-shaped member 60. Understandably, both the ring-shaped member 60 and the skirts 61, 62 may be segmented into, for example, four or eight equally sized segments in order to facilitate easy installation. In order to further simplify installation, the teardrop shaped lower edge may be preassembled by securing it to a length of pipe, the dimensions of which match those of the exit pipe 30 such that the length of pipe can simply be appended to the exit pipe 30. In a first embodiment of the teardrop shaped lower edge illustrated in FIGS. 8 and 9, the teardrop shaped profile 57 is orientated vertically downward. In a second embodiment illustrated in FIG. 10, the ring-shaped member 60 is outwardly disposed relative to an edge of the exit pipe 30 such that the inner skirt 61 is substantially upright and the outer skirt 62 is slanted. This configuration illustrated in FIG. 10 will be used where a gap between the exit pipe 30 and the feed pipe 22 is small resulting in a too high exit velocity.

Figure 12:
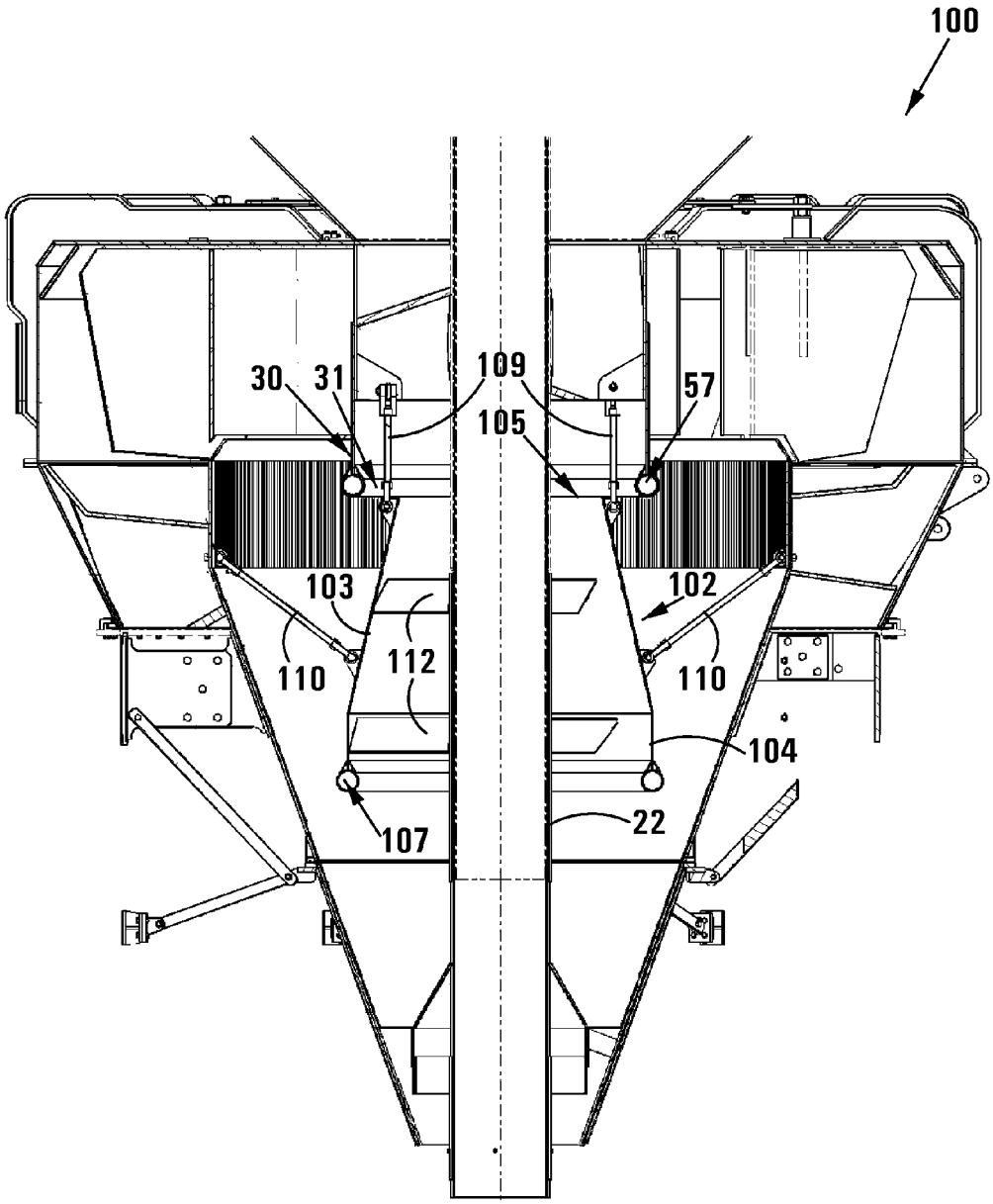
FIG. 12 illustrates a longitudinal cross-section through a further embodiment of a classifier in accordance with invention.

A further embodiment of a classifier in accordance with the invention is illustrated in FIG. 12 and is designated by reference numeral 100. Like reference numerals have been used to refer to similar features of the classifier 100. The classifier 100 is similar to the classifier 10 described earlier, but includes an additional part conical member 102 which is concentrically arranged about the feed pipe 22 and is disposed immediately below the vortex finder 30. An operatively upper periphery of the conical member 102 is positioned in, or immediately below, the exit passageway 31 defined by the vortex finder 30. The upper periphery of the conical member 102 defines an annular mouth 105 which ideally occupies half of a cross-sectional area of the exit passageway 31. The part conical member 102 includes a cone 103 which diverges toward the bottom and leads into a cylindrical skirt 104 having a tear drop profiled lower periphery 107 which corresponds with the profile 57 of the vortex finder 30.

Figure 13:
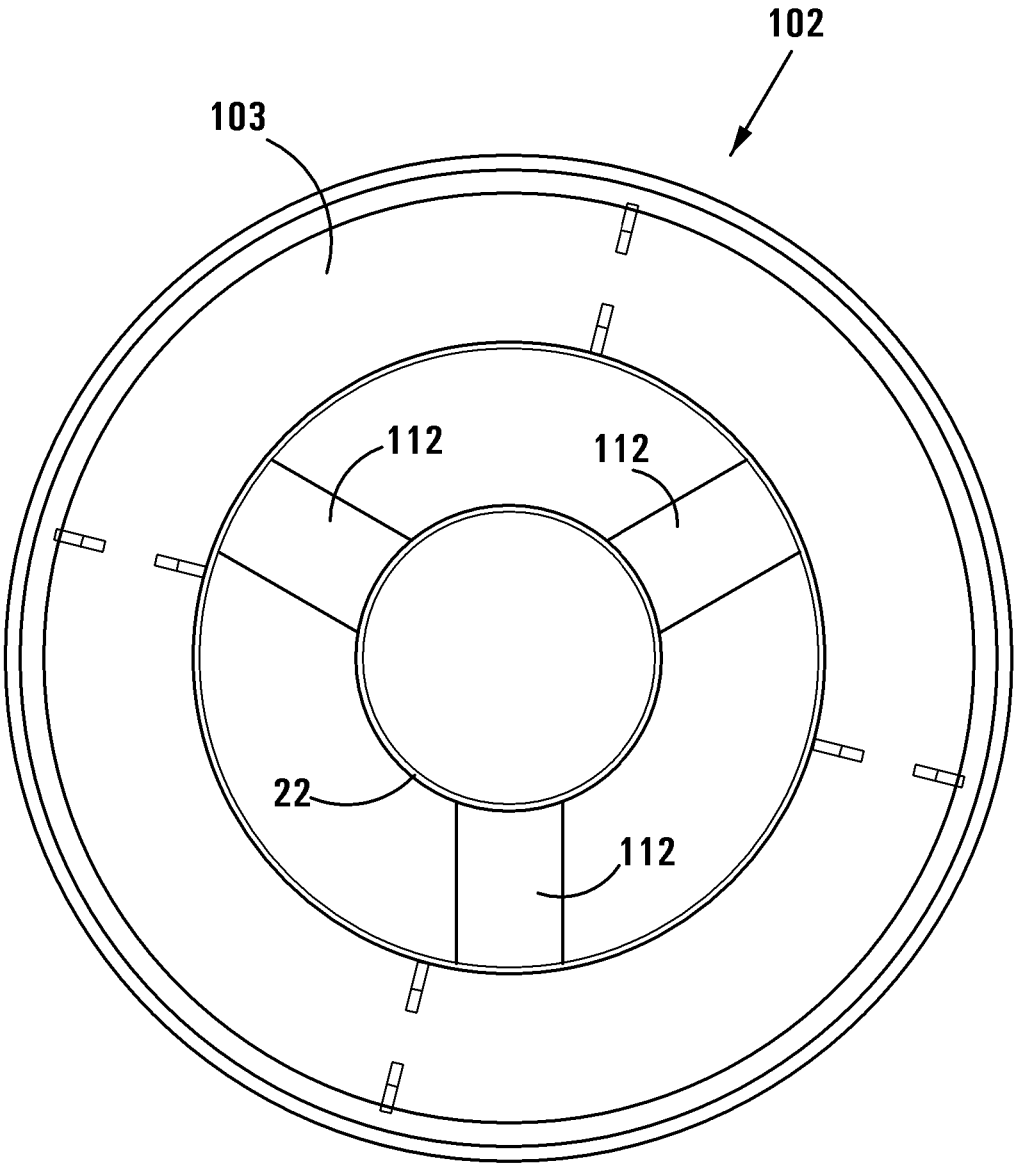
FIG. 13 shows a top view of a part conical member forming part of the classifier of FIG. 12.
Figure 14:
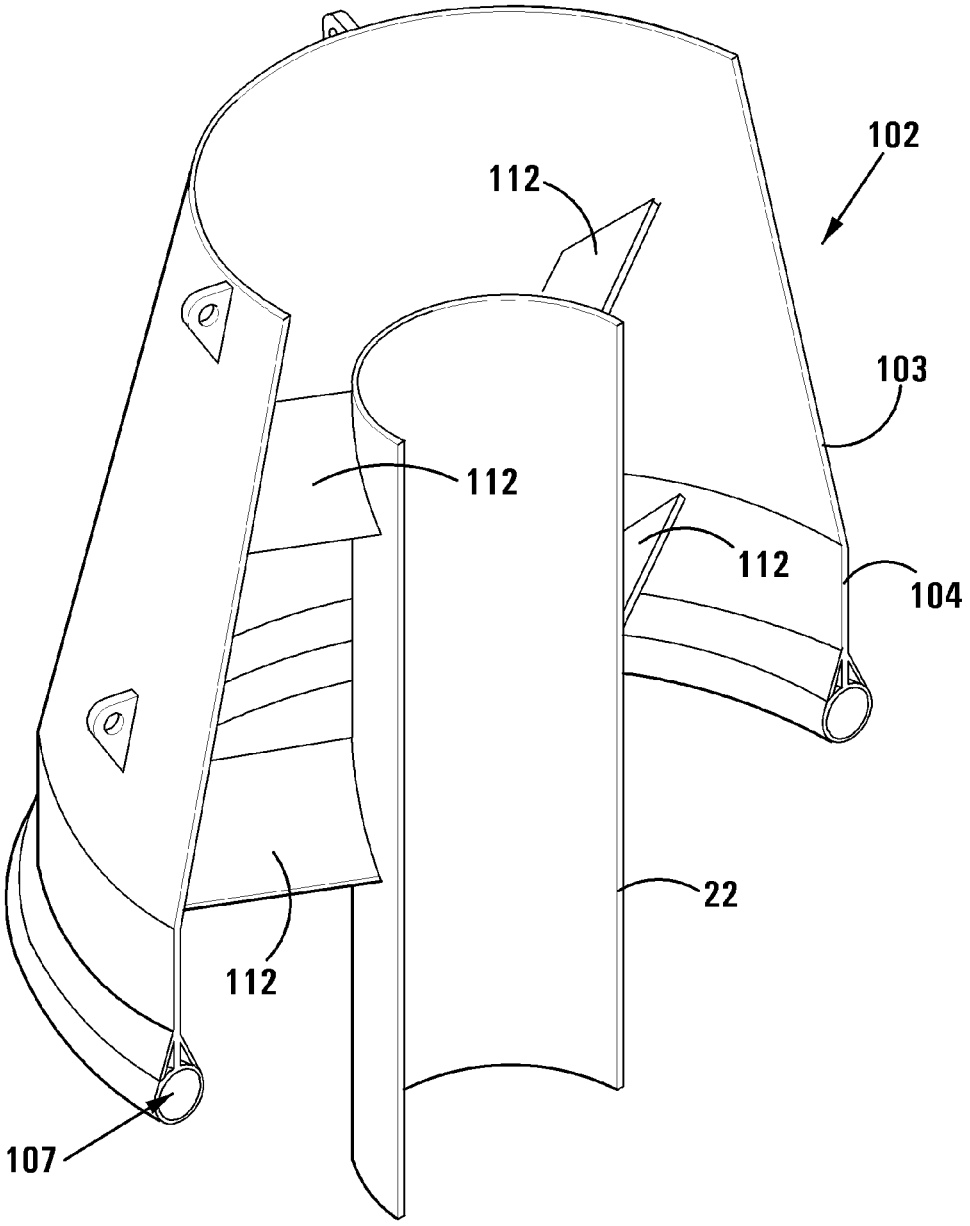
FIG. 14 shows a three-dimensional longitudinal section through the part conical member of FIG. 13.

A height of the conical member 102 with respect to the vortex finder 30 is adjustable by increasing/decreasing a length of adjustable struts 109 secured to an upper part of the cone 103. The conical member 102 is also supported by external struts 110 connecting the cone 103 to the inner housing 15. A pair of three angularly spaced apart inclined braces 112, each of which is connected to the feed pipe 22, support the conical member 102 from the inside (see FIGS. 13 and 14). Although this has not been clearly illustrated, a length of the conical member 102 may be adjustable in order to optimise efficiency of the classifier 100.

Figure 15:
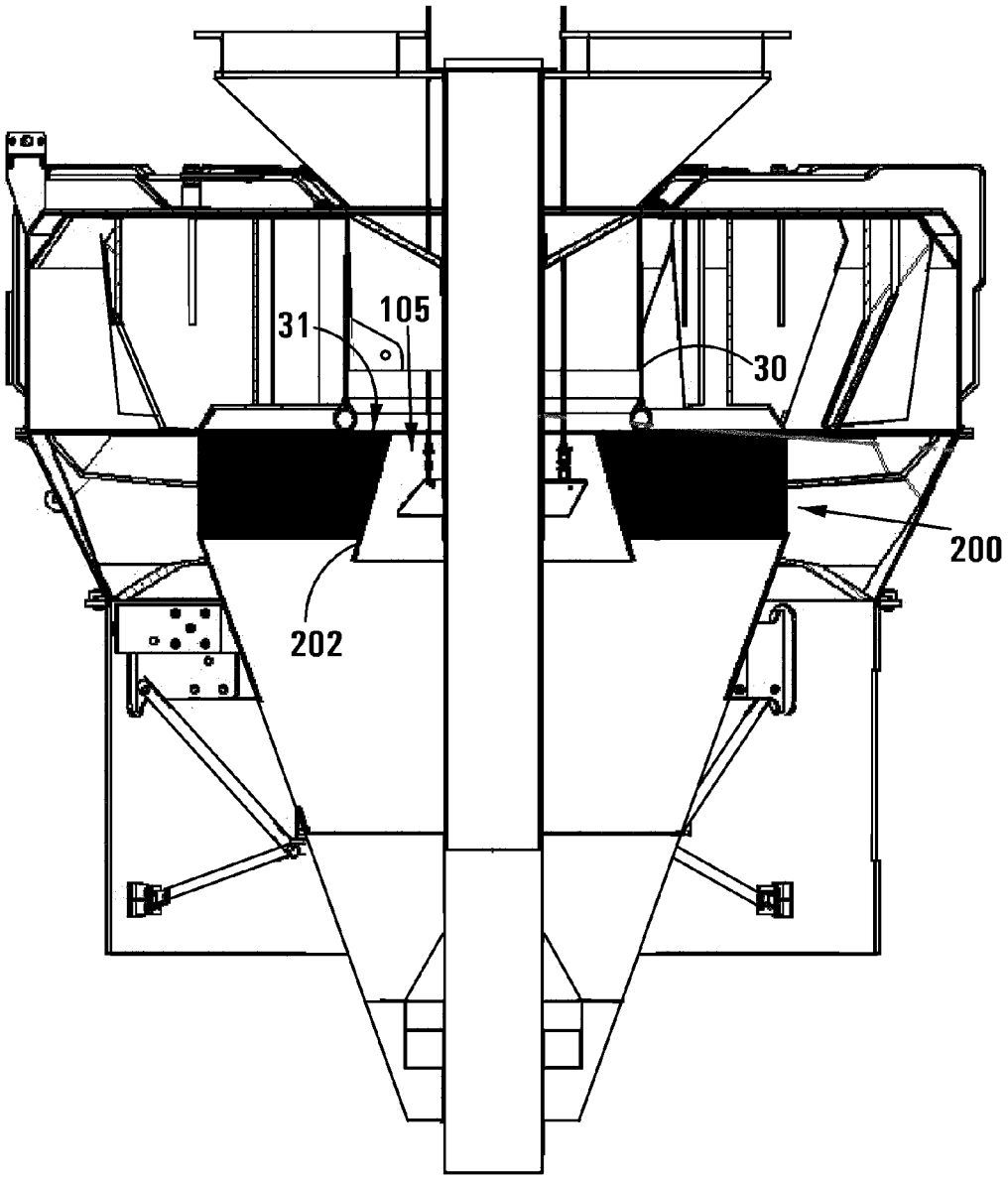
FIG. 15 shows a longitudinal section through yet another embodiment of a classifier in accordance with the invention.

An alternative embodiment of the classifier in accordance with the invention is illustrated in FIG. 15 and is designated by reference numeral 200. The classifier 200 is essentially the same as the classifier 100 but instead of the part conical member 102, the classifier 200 includes a cone 202 which is concentrically arranged about the feed pipe 22 such that an upper periphery of the cone 202 is arranged within or immediately below the vortex finder 30 and defines a mouth 105 which ideally occupies half of a cross-sectional area of the exit passageway 31. The cone 202 diverges toward the bottom. The cone 202 is suspended in place by braces and struts and accordingly, the position of the cone 202 with respect to the vortex finder 30 and a length of the cone 202 may be adjustable in order to achieve a desired outlet particle size exiting the classifier 200.

In use, air-entrained, crushed particulate material received from the pulveriser is directed along the airflow pathway 27 and passes through the pre-swirl vanes 47. The upstream portion 53 of each vane 47 is downwardly directed in the direction of the airflow such that it is substantially parallel with the flow direction of the incident particles in order to minimise flow resistance and wear. The particles then encounter the inclined middle 55 of the vane 47 which induces a vortex. Finally, as the particles pass the downstream portion 54, the upwardly and inwardly inclined outer corner 51 or upper kink forces the particles inward toward the classifier inlet blades 37 above.

The adjustable inlet blades 37 receive the airflow from the vanes 47 below in an upward and inward direction. The lower corner 45 of each blade 37 is angled or kinked to allow smooth inlet flow conditions into the blades 37. The angle of the blades 37 is adjustable by manipulating the blade adjustment mechanism 39 in order to regulate swirl and product fineness. The blade length is determined using velocity requirements at the blade outlet to set swirl conditions to suit fineness adjustability. The airstream is then directed into the classification zone 19 via the inlet 20 where it is subjected to classification action. The lower edge of the exit pipe or vortex finder 30 which has a teardrop or aerofoil profile 57 then receives the fine particles entrained in an upward airflow flowing along the exit passageway 31. In previous designs, this lower edge was plain or manufactured from two inverted cones and produced turbulence around its lower periphery which resulted in resistance losses. The teardrop or aerofoil profile 57 reduces flow separation and resultant resistance losses.

In respect of the classifiers 100, 200, the conical members 102, 202 improve efficiency of the classifier and hence product fineness. If it is desirable to increase particle size, the length of the conical member 102 can be reduced, hence increasing a gap between the grit funnel 21 and the lower periphery 107. Also, by lowering the position of the conical member 102 with respect to the vortex finder 30, the resultant particle size will be increased. The performance of the classifiers 100, 200 can therefore be fine tuned by adjusting the position and length of the conical members 102, 202.

The Inventors believe that by introducing the above design modifications, the throughput of the classifier 10, 100, 200 can be improved by a significant percentage (e.g. 15%) or product fineness improved at similar resistances over existing designs. The inlet blades 37, pre-swirl vanes 47, modified vortex finder 57 and conical members 102/202 serve to improve efficiency and reduce resistance to flow throughout the classifier 10 hence improving throughput capabilities or product fineness at similar resistances which suits low $NO_x$ requirements of present boilers.

The invention claimed is:

1. A classifier for use with a pulveriser which is configured to crush raw material, the classifier being configured to classify air-entrained, crushed particulate material received from the pulveriser into a fine fraction which is expelled from the classifier and a coarse fraction which is returned to the pulveriser for further crushing, the classifier including:

a housing defining:

an inward classification zone;

an inlet through which the entrained crushed particulate material received from the pulveriser enters the classification zone; and an operatively upper exit and an operatively lower outlet which lead from the classification zone;

a plurality of classifier inlet blades which are arranged at or near the inlet; and a plurality of angularly spaced apart, inclined pre-swirl vanes which are disposed upstream of the inlet blades, wherein each pre-swirl vane comprises a multi-planar body, wherein the pre-swirl vanes are disposed around an upper region of an outer periphery of walls of the housing defining the classification zone and wherein the multi-planar body of each vane includes an operatively upstream portion and an operatively downstream portion, the upstream and downstream portions being joined by a middle, wherein the upstream portion is downwardly inclined with respect to the middle such that the upstream portion is substantially parallel to an incoming air stream in order to minimize air flow resistance and wear; and at least part of the downstream portion is upwardly and inwardly inclined with respect to the middle and configured to direct fluid flow inward and to induce a centrifugal swirl.

2. A classifier as claimed in claim 1, wherein the upstream portion of each vane is downwardly inclined at an angle of between 20° and 40° relative to the middle of the vane body and wherein a fold line or bend line representing a start of the upstream portion is parallel with a lower edge of the upstream portion, wherein an outer corner of the downstream portion of each vane is inclined at an angle between 20° and 40° with respect to the middle of the vane body, wherein the middle of each vane body is inclined at between 30° and 60° with respect to the vertical and wherein inner and outer edges of each vane match profiles of neighbouring walls of the classifier and wherein a gap is defined between the outer edges of the vanes and a mill body, the gap being smaller than or equal to half a width of a pre-swirl vane.

3. A classifier as claimed in claim 1, wherein there is at least one inlet blade for every two pre-swirl vanes.

4. A classifier as claimed in claim 1, wherein the pre-swirl vanes have a vane-to-vane overlap of at least one third of a vane breadth.

5. A classifier as claimed in claim 1, wherein a lower edge of the housing defining the upper exit has an aerofoil or teardrop cross-sectional profile which is configured to reduce turbulence and flow resistance at the exit of the classifier.

6. A classifier as claimed in claim 1, which includes an open ended depending member which is at least partially disposed within the classification zone, the member having a narrow upper end and a lower end, the member diverging from the upper end toward the lower end, the upper end defining a mouth having a reduced cross-sectional area when compared with a cross-sectional area of the upper exit, wherein the upper end of the depending member is arranged within or below the upper exit.

7. A classifier as claimed in claim 6, wherein the depending member is supported by a plurality of adjustable struts which permits a position of the depending member within the classification zone to be adjusted.

8. A classifier as claimed in claim 7, wherein the depending member is in the form of a cone and the mouth of the depending member is concentric with the upper exit such that the upper end is positioned in the middle of the upper exit.

9. A classifier as claimed in claim 8, wherein a length of the depending member, and hence the extent to which the depending member extends downwardly into the classification zone, is adjustable.

10. A classifier as claimed in claim 1, wherein the classifier inlet blades are adjustable, each adjustable blade including a body which comprises an operatively upstream portion which is outwardly disposed away from the inlet and an operatively downstream portion which is disposed at least partially within and/or immediately above the inlet, wherein at least part of the upstream portion of each adjustable blade is inclined with respect to the downstream portion of the blade body, the adjustable blades collectively being configured to induce swirl and to direct the entrained particulate material through the inlet into the classification zone.

11. A classifier as claimed in claim 10, wherein the classifier is a static classifier and a corner of the upstream portion of each blade is inclined at an angle of between 20° and 40° with respect to the downstream portion of the blade body when viewed edge-on from a bottom of the blade body and wherein the corner of the upstream portion is separated from a remainder of the blade body by a fold line or bend line which is substantially perpendicular to a diagonal extending between a pair of opposing corners of the blade body.

12. A classifier as claimed in claim 10, wherein each adjustable blade includes a mounting formation whereby the blade is mounted to the housing and which includes an inlet blade adjustment mechanism which is connected to the mounting formations of each of the blades in a configuration in which an angle of each blade body relative to the housing is adjustable in order to regulate air flow through the inlet, by adjusting the blade adjustment mechanism.

13. A classifier as claimed in claim 12, wherein, in use, an air/particle velocity through the blades is between 4.5 and 5.5 m/s.

14. A classifier for use with a pulveriser which is configured to crush raw material, the classifier being configured to classify air-entrained, crushed particulate material from the pulveriser into a fine fraction which is expelled from the classifier and a coarse fraction which is returned to the pulveriser for further crushing, the classifier including:

a housing defining:

an inward classification zone;

an inlet through which the entrained crushed particulate material received from the pulveriser enters the classification zone;

an operatively upper exit and an operatively lower outlet which lead from the classification zone;

a plurality of classifier inlet blades which are arranged at or near the inlet; and a plurality of angularly spaced-apart inclined pre-swirl vanes which are disposed upstream of the inlet blades, wherein each pre-swirl vane comprises a multi-planar body, the classifier inlet blades being adjustable, each adjustable blade including a body which comprises an operatively upstream portion which is outwardly disposed away from the inlet and an operatively downstream portion which is disposed at least partially within and/or immediately above the inlet; wherein at least part of the upstream portion of each adjustable blade is inclined with respect to the downstream portion of the blade body, the adjustable blades collectively being configured to induce swirl and to direct the entrained particulate material through the inlet into the classification zone, the classifier being a static classifier and a corner of the upstream portion of each blade being inclined at an angle of between 20° and 40° with respect to the downstream portion of the blade body when viewed edge-on from a bottom of the blade body and wherein the corner of the upstream portion is separated from a remainder of the blade body by a fold line or bend line which is substantially perpendicular to a diagonal extending between a pair of opposing corners of the blade body.

* * * * *